US005477820A

United States Patent [19]

Rao

[11] Patent Number: 5,477,820

[45] Date of Patent: Dec. 26, 1995

[54] THERMAL MANAGEMENT SYSTEM FOR HEAT ENGINE COMPONENTS

[75] Inventor: V. Durga N. Rao, Bloomfield Township, Mich.

[73] Assignee: Ford Motor Company, Dearborn, Mich.

[21] Appl. No.: 315,162

[22] Filed: Sep. 29, 1994

[51] Int. Cl.[6] ..... F02B 77/11; F02B 75/08

[52] U.S. Cl. ..... 123/193.6; 123/193.2; 123/668

[58] Field of Search ..... 123/193.3, 193.1, 123/193.6, 193.2, 657, 668

[56] References Cited

U.S. PATENT DOCUMENTS

| | | | |
|---|---|---|---|
| 2,410,405 | 11/1946 | Cornelius | 92/209 |
| 2,519,683 | 8/1950 | Marien | 428/550 |
| 2,575,214 | 11/1951 | Garland et al. | 92/223 |
| 2,609,260 | 9/1952 | Marien | 277/188 R |
| 3,012,831 | 12/1961 | Cheney et al. | 92/224 |
| 3,095,204 | 6/1963 | Neely | 277/189.5 |
| 3,890,950 | 6/1975 | Haldenar | 123/193.4 |
| 3,917,290 | 11/1975 | Geffroy | 277/75 |
| 3,938,814 | 2/1976 | Cromwell | 277/235 A |
| 3,942,808 | 3/1976 | Gross | 277/197 |
| 3,974,309 | 8/1976 | Uy | 427/250 |
| 4,495,907 | 1/1985 | Kano | 123/193.2 |
| 4,599,270 | 7/1986 | Rangaswamy et al. | 428/402 |
| 4,612,260 | 9/1986 | Kumagai et al. | 428/667 |
| 4,852,542 | 8/1989 | Kano et al. | 123/193.3 |
| 4,867,119 | 9/1989 | Cooper et al. | 123/41.35 |
| 5,038,725 | 8/1991 | Okazaki et al. | 123/540 |
| 5,133,564 | 7/1992 | Chang | 277/193 |
| 5,236,787 | 8/1993 | Grassi | 428/552 |
| 5,305,726 | 4/1994 | Scharman et al. | 128/193.6 |

*Primary Examiner*—David A. Okonsky

*Attorney, Agent, or Firm*—Joseph W. Malleck; Roger L. May

[57] ABSTRACT

Heat engine piston and combustion chamber construction enclosing a gas combustion zone, comprising: a piston body having a crown facing said gas combustion zone; combustion chamber surfaces cooperating with said piston to complete enclosure of said zone; and a thermal diffusivity coating on said crown and combustion chamber surfaces having an effective thickness to operate as a thermal diode to restrict heat transfer to said piston body and combustion chamber and to restrict heat transfer to said combustible charge prior to combustion. A method of thermally managing heat generated by an internal combustion engine, the engine having combustion chamber walls for combusting a gaseous mixture of air and fuel, a cooling jacket for cooling said walls, and a piston moveable along a portion of said walls, comprising: increasing the compression ratio of the engine to induce engine-knock for an uncoated chamber; coating at least the crown of the piston of said combustion chamber walls with a low thermal diffusivity layer that functions as a heat diode to restrict heat transfer in both directions normal to the coating; operating said engine with said coating chamber wall and increased compression ratio, whereby fresh intake of combustible mixture to said combustion chamber will be drawn thereinto at a lower temperature and volumetric efficiency with less heat from said combustion being wasted to said cooling jacket.

21 Claims, 5 Drawing Sheets

THERMAL MANAGEMENT SYSTEM FOR HEAT ENGINE COMPONENTS

BACKGROUND OF THE INVENTION

1. Technical Field

This invention relates to the art of designing and fabricating pistons and related heat engine component surfaces for a fossil fueled engine, which surfaces affect the conversion of chemical energy to mechanical energy and which affect emissions resulting from the combustion process; more particular the invention relates to combustion chamber and charge induction surfaces, including piston designs and materials that (i) can store and release heat selectively, (ii) control or limit temperature of piston and component surfaces, or (iii) control or inhibit thermal expansion of components, primarily pistons, in an internal combustion engine (IC).

2. Discussion of the Prior Art

In heat engines, such as IC engines (gasoline or diesel) used in automotive vehicles today, some of the heat of combustion gases is siphoned off through a thermal path that proceeds through the piston (which is usually constructed of aluminum alloy in a gasoline engine), through the piston rings, to a metallic engine block and cylinder head that are cooled by a water jacket that in turn dumps such heat. Such parasitic heat loss limits the available power and engine efficiency. Because of the dynamics of the combustion cycle and the heat transfer characteristics of an IC engine, a significant amount of heat along such thermal path is stored in these components during the combustion and exhaust portions of the engine operating cycle. A part of this stored heat is transferred to the fuel/air charge during the intake and the compression strokes (e.g. 4-cycle engine). This is particularly disadvantageous for the operation of a spark ignition gasoline engine; its compression ratio will be determined by the knock-limit and therefore the compression ratio is chosen to avoid engine knock resulting from auto ignition. However, the higher the knock-limited compression ratio, the higher will be the power and engine efficiency. Conversely, for every one point reduction in the compression ratio, due to such design limitations, there is a corresponding reduction in engine fuel economy of about 2–2.5 percent and a 2.5–3.0 percent loss in engine power. The compression ratio is reduced because high compression would more readily heat up a less dense gas to above the knock temperature limit.

It would be desirable to preserve as much of the heat of combustion to do mechanical work during the combustion/expansion stroke for driving the vehicle. In the case of the spark ignition engine, it is desirable to control the heat input into the charge from the piston, or other combustion chamber components, during the intake stroke, thereby increasing volumetric efficiency of the engine. Stored heat that is transferred to the induction charge should only be enough to improve either evaporation of the fuel for avoiding condensation on the bore wall. In the case of a diesel engine, after engine warm-up, the charge air density is more important. Unlike the spark ignition engine, the warmer the charge after the intake valve closes, the better it is for engine operation because of reduced ignition delay which improves engine combustion. it would also be desirable to control the thermal expansion characteristic of the piston body adjacent the piston crown when managing such thermal conditions.

Attempts by the prior art to thermally manage heat flow through pistons have been restricted to the use of certain types of thermal barriers (Teflon in U.S. Pat. No. 2,817,562; nickel metal in U.S. Pat. No. 5,158,052; and chromium oxide in U.S. Pat. No. 4,735,128). Such thermal barriers are insufficient to manage heat properly because they must be unduly thick thereby adversely affecting volumetric efficiency (i.e. allowing too much stored heat to be transferred to the induction charge); no provision is made to remove the stored heat from the combustion chamber surfaces independent of charge absorption.

SUMMARY OF THE INVENTION

It is an object of this invention to provide a method of heat management, as well as an engine construction that incorporates such heat management, that accomplishes one or more of the following: (i) control and manage heat transfer to reduce heat wasted to engine cooling systems, (ii) maintain the average temperature of the engine components at a lower level, and (iii) limit stored heat from unduly heating the gas mixture charge during intake and compression. Such heat management leads to greater volumetric efficiency of the engine, a reduction in emissions, and an increase in engine power while permitting an increase in compression ratio for a gasoline engine.

In a first aspect, the invention is a heat engine piston and combustion chamber construction that employs a low thermal diffusivity coating which functions as a heat transfer diode, that is, the coating restricts heat flow from the combustion chamber during combustion while allowing some limited heat transfer during the expansion and exhaust strokes of the piston; the coating limits or prevents the stored heat from flowing into the fresh combustible charge during the intake and compression strokes. Since diffusivity is inversely proportional to density and mass specific heat capacity of the coating material, the material must be selected with attention to more than thermal conductivity, the latter being solely characteristic of prior art selections. The prior art which impregnates chromium oxide, as an example, prevents the material from acting as a thermal diode since chromium oxide has a high thermal diffusivity. The thickness of the low diffusivity diode coating is important because it muse be minimal while having sufficient mass to assure appropriate thermal transfer behavior.

In a second aspect, the invention is a method of thermally managing heat generated by an internal combustion engine no increase power and fuel economy. The method comprises: (a) increasing the compression ratio of the engine by 10–20%; (b) coating the crown of the piston and combustion chamber surfaces with a low thermal diffusivity layer Than functions as a heat diode; and (c) operating the engine with such coating crown and surfaces using the increased compression ratio whereby a fresh intake mixture to the combustion chamber will be drawn thereinto at a much lower temperature for a higher volumetric efficiency with less heat from the combustion chamber wasted to the cooling jacket of the engine block during the initial heat release portion of the combustion/expansion stroke. The heat that eventually does transfer through the diode coating to the piston body and engine block and head is controlled to keep their temperature lower and assist the functioning of the coating by imposing a lower thermal differential. This also avoids undue thermal expansion of the aluminum piston body. The control can be obtained by: (a) an improved thermally conductive abradable coating on at least the top land of the piston body to conduct available heat to water cooling of the block and the head; (b) spraying oil coolant onto the interior of the piston which oil coolant is preferably isolated from valve train coolant and thus can be at a lower viscosity; and (c) planting of a cast-in-place thermal expansion inhibitor in the piston body adjacent The piston crown. To assist attaining enhanced volumetric efficiency, the intake (and exhaust) manifold walls are fabricated to have double walls/air gap insulated construction to prevent the heating of the fresh charge as it travels from the air intake into the engine through the intake ports. The double wall construction features a very thin inner wall (approximately 0.015 to 0.031 inches) a very low thermal conductivity stainless steel. This not only insulates engine heat from flowing into the charge, but also reduces the fuel condensation during a cold start.

DETAILED DESCRIPTION AND BEST MODE

Without heat management coatings, on the piston and combustion chamber walls, and without use of double wall construction of the intake and exhaust manifolds, a significant portion of the heat of combustion from an IC heat engine will be conducted to the crown of an aluminum piston and to the cylinder head during the expansion and exhaust strokes. The hotter piston will transfer such heat, in a conventional engine, through the piston rings which contact the cylinder block and thence to a cooling jacket (in block or head) where the heat is eventually dumped. The hotter head similarly will transfer heat to a cooling jacket that extends thereinto where the heat will be dumped. These heat disposal paths are limited and severely restricted; the mass of the aluminum piston is forced to act as a heat sink. Heat absorbed by the piston body, particularly the crown surface of a non-coated piston, will transfer the absorbed heat throughout the mass of the piston because of the high thermal conductivity of the piston metal, such as aluminum. As a result, the piston will be hotter and weaker. The hotter piston and combustion chamber surfaces adversely affect the temperature of the incoming intake mixture into the combustion chamber during the intake and compression strokes; the intake air/fuel mixture will attain a relatively higher temperature at the end of the intake stroke compared to its start, with a reduced volumetric efficiency. The engine designer will adjust the compression ratio of the spark ignition engine to avoid knock. For example, the combustion gas temperature at the end of the compression stroke must be designed to be lower by limiting the compression ratio. The heat on the skin of the piston crown will auto ignite the combustible mixture in the combustion chamber if it exceeds the designed temperature by 30°–40° F. In addition, due to the hotter temperature of the aluminum piston (resulting from the absorbed and diffused heat), the piston will experience a higher thermal expansion characteristic different than the material constituting the cylinder bore wall. This necessitates design of the aluminum piston to have a clearance at the most extreme temperature conditions, such as at full engine load, to accommodate the worst case of differential thermal expansion between the piston and the cylinder bore wall. At part-load conditions of an engine, the aluminum piston to bore clearance will therefore be increased because of reduced temperature and consequent reduced thermal expansion of the piston. This significantly increases the crevice volume between the piston and bore wall, thereby increasing the high carbon emissions as well as gaseous blow-by pass the piston rings and crown.

Figure 1:
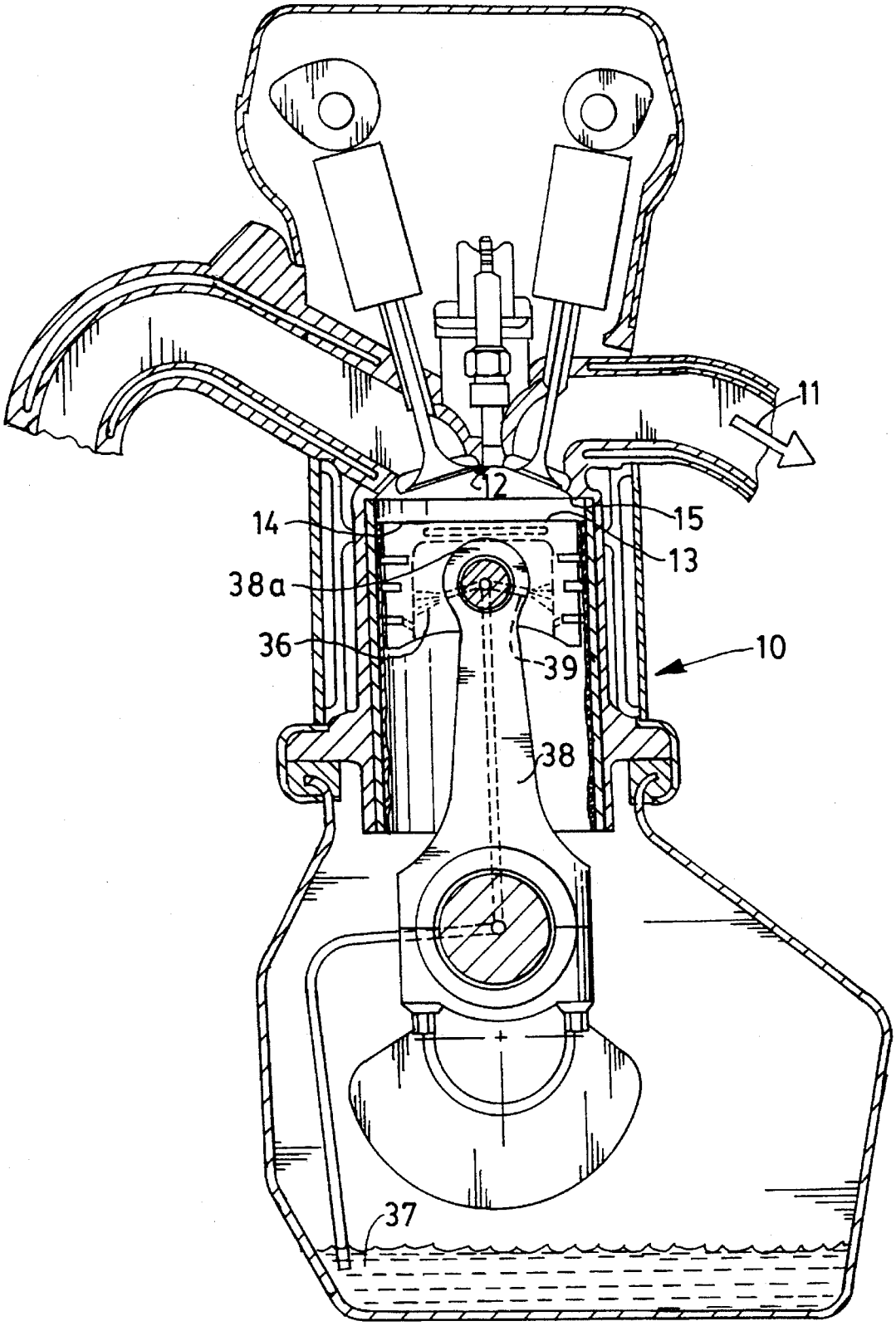
FIG. 1 is a central sectional elevational view of an internal combustion spark ignition engine depicting the thermal heat management characteristics of this invention.
Figure 2:
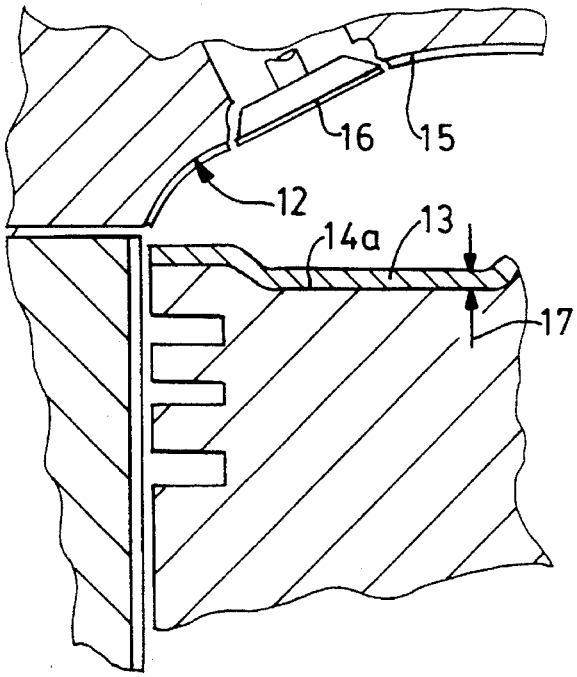
FIG. 2 is an enlarged fragmentary sectional view of the coated combustion chamber of FIG. 1.

As shown in FIG. 1, this invention employs heat management coatings or plys to increase the volumetric efficiency of a heat engine 10, prevent auto ignition at higher compression ratios in the case of a spark ignition engine, and reduce exhaust emissions 11 as well as prevent contamination of the combustion chamber surfaces 12 over the life cycle of the heat engine. First, a low thermal diffusivity (low alpha) coating 13, operating as a thermal diode, is applied to the piston crown and to the combustion chamber surfaces 15 in the head (see FIG. 2), including valve head surfaces 16. Thermal diffusivity is an expression of the ratio of thermal conductivity watts/meter °K.) to the multiple of density (Kg/meter$^3$) and mass specific heat capacity (Joules/kilogram °K.). A good low thermal diffusivity number for this invention is about half that of that for aluminum, such as $93\times10^{-6}$ for Al, zirconia $54\times10^{-6}$, 316 stainless steel $51\times10^{-6}$ and Ti alloy $62\times10^{-6}$ metric units. To function as a diode for purposes of this invention, the coating must be (i) relatively low in thermal conductivity, (ii) be capable of holding a predetermined desirable quantity of heat calories to limit the conduction of heat in a direction that would be wasted to tooling, and (iii) be sufficiently thin or low enough in mass to limit flow of stored heat in a reverse direction to an incoming colder gas charge. The coating temperature will rise, with little heat transfer going across the coating; then at the end of the exhaust stroke, the piston crown will be cooler, in heating heat flow into the metal components, but not in impeding heat flux out of the components to a coolant. The diode coating will essentially slow down or limit heat transfer to the cooling system, stored heat is limited so as to restrict transfer back to the fresh incoming charge during the intake stroke and compression, and heat that does get into the piston or is readily removed by better conduction paths which will be described subsequently. The diode coating will typically reach a stable temperature of about 375° F. in a spark ignition gasoline engine, allowing the piston crown below the coating to be at least 100° F. cooler, assuming the gas mixture is about 500° F. and the coolant temperature is about 100° F.

Examples of thermal diffusivity material that will function as a thermal diode for purposes of this invention include titanium aluminide, titanium-6Al alloy, zirconium oxide, thorium oxide, and 200 or 300 series stainless steel (u,e, 316 ss) having chromium (of about 20%) and nickel (of about 8%).

The following table illustrates specific thermal diffusivity numbers for each of the recited examples including their accompanying thermal conductivity, density and specific heat values.

| Coating | Thermal Conductivity w/m°K. | Density Kg/m$^3$ | Specific Heat J/Kg°K. | Thermal $\times 10^{-6}$ Diffusivity |
|---|---|---|---|---|
| Thorium oxide | near zero | near zero | near zero | near zero |
| Zirconium oxide | 13.8 | 7000 | 699 | 54 |
| Titanium Aluminum Alloys | 20.5 | 5060 | 650 | 62 |
| Stainless Steel | 20.7 | 8030 | 502 | 51 |

Thermal conductivity should be low, in the range of near zero to 21 W/M°K.; the density is usually in operable range of 5000–9000 Kg/m$^3$; the specific heat is greater than 500 J/Kg°K.; the thickness of the coating should be in the operable range of 0.75 to 1.22 mm; and the thermal diffusivity is thus about near zero to 62.

Figure 3:
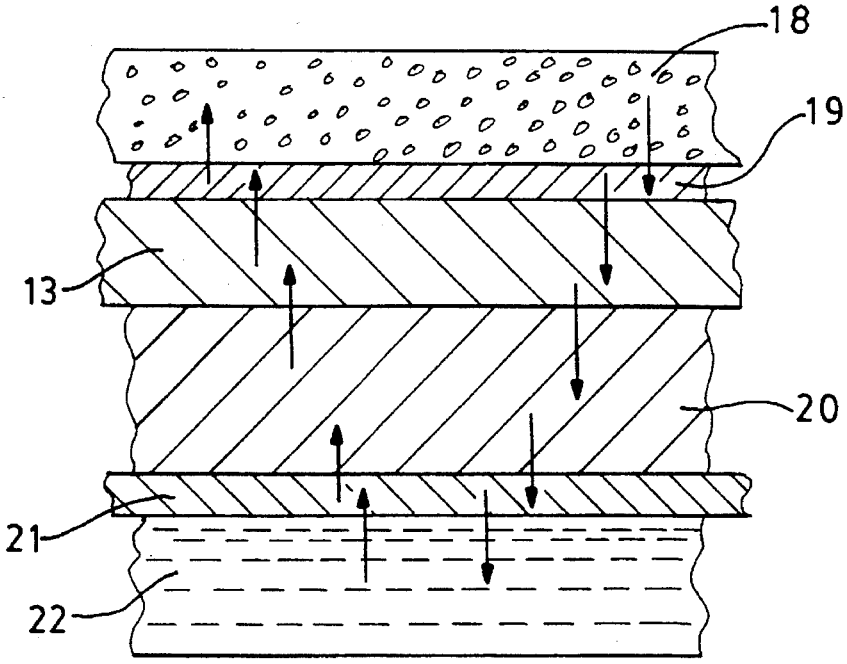
FIG. 3 is a diagram of the physics of heat transfer from a gas mixture through various mediums including a gas skin layer, the coating of this invention, the metal substrate, a liquid skin of coolant, and the liquid coolant itself.
Figure 4:
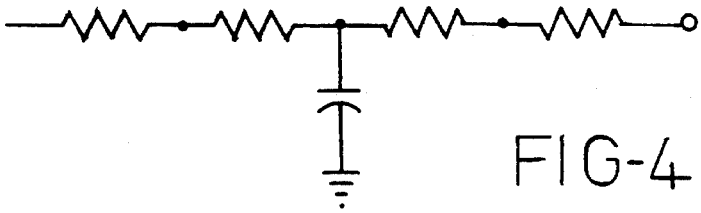
FIG. 4 is a schematic representation of how the mediums of FIG. 3 act as resistances to thermal flow.
Figure 5:
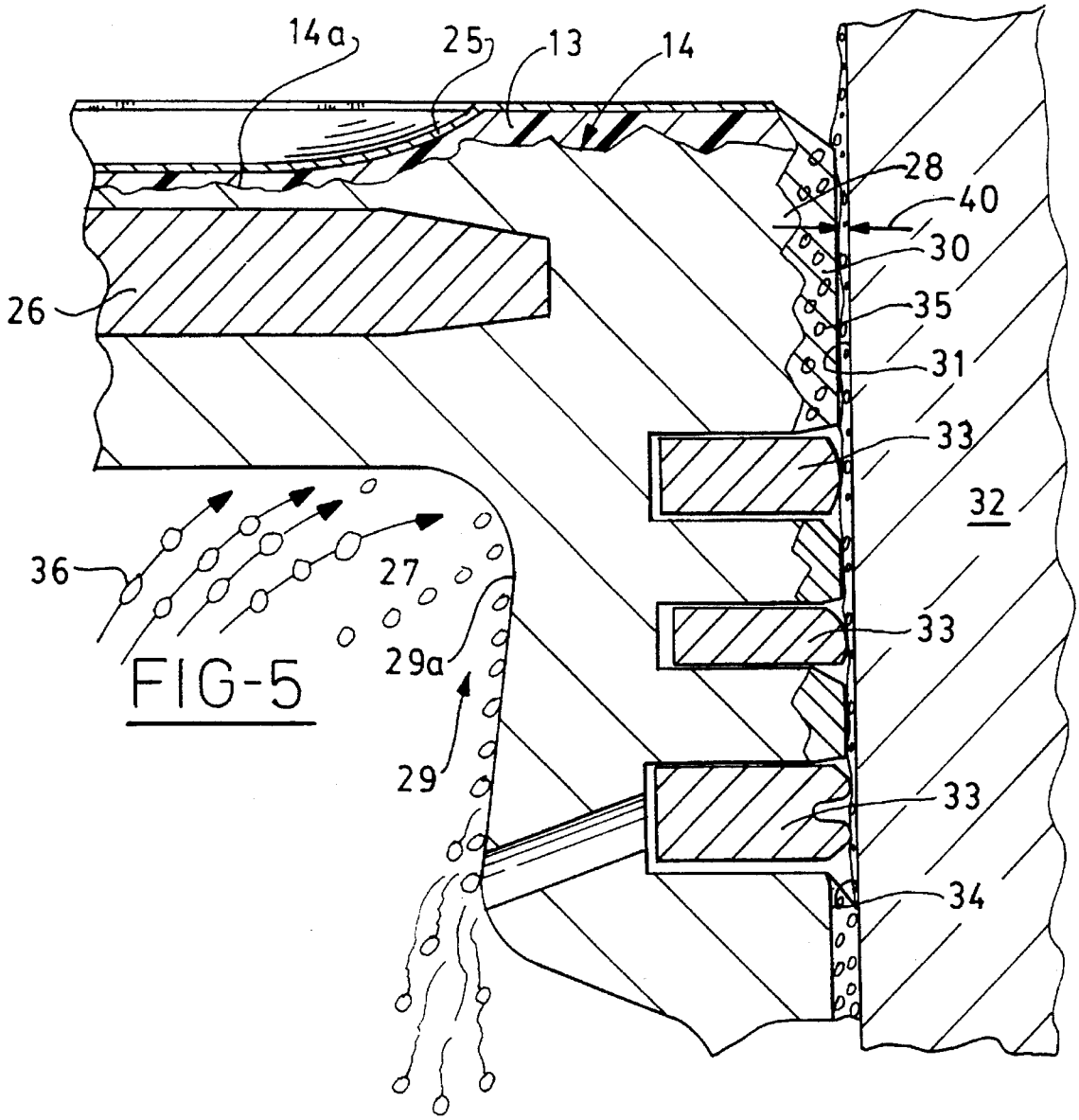
FIG. 5 is a greatly enlarged fragmentary cross-sectional view of the upper right hand corner of a piston within a cylinder bore wall of an internal combustion engine embodying more fully the thermal management principles of this invention.

The thickness 17 of such low diffusivity coating is critical to its functioning as a thermal diode due to cyclic operation (i.e. heating and cooling) of the engine components. As shown in FIG. 3, the physics of heat loss from the gas mixture 18 can be visualized to thermally consist of a path through a gas boundary layer 19 immediately adjacent the solid metal 20 (or low thermal diffusivity coating 13 in the case of the present invention), through the thickness of the solid metal, and thence through a thin boundary layer 21 of air or water coolant 22 (serving to receive the transfer heat and dump to atmosphere). There is a thermal gradient through each layer 19, 20 and 21 with the greatest but shortest gradient apparent in layers 19 and 21. Similarly heat loss physics occurs through the upper margins 23 of the cylinder walls, but such heat loss is additionally affected by oil splashed therealong from the engine crank case. The optimum thickness of the coating for the various materials has proven by experimental data to be 0.70 mm for thorium oxide, 0.76 mm for zirconium oxide, 0.80 mm for titanium aluminide, and 0.85 mm for 316 stainless steel The coating is preferably applied by first preparing the crown piston surface 14 and other combustion surfaces 15 and valve head surface 16 to be clean and free of contamination; secondly, the diode coating material is deposited onto such cleaned surface, such as by plasma/thermal spraying onto the piston crown and other combustion chamber surfaces. The thermal diffusivity material can be applied in a powder form injected into the plasma or be dissolution in a solvent for ambient temperature spraying. The plasma sprayed coating should have a bond strength to the piston that exceeds 2000 psi, preferably above 6000 psi, and a porosity of 3–5%. If solvent spraying is employed, the solvent is filled prior to spraying with appropriate solids such as zirconia, titanium-aluminum alloy or stainless steel, as well as an appropriate bonding agent such as a high temperature polyimide-amide. Upon completion of solvent spraying, the mixture will stick to the substrate, after which the solvent will evaporate. If the piston crown 14 has a dished surface 14A, the coating 13 will following the contours of such central dishing (see FIGS. 2 and 5). To allow such conformity, the particle size of the powder material utilized, in the deposition, is within the range of 85–30 microns, but preferably 60–45 microns.

The chamber walls, particularly the aluminum piston crown 14, may collect isolated or dispersed carbon deposits during operation, which deposits eventually will become coked and create contaminations that induce auto ignition as well as abrasion and scuffing of the cylinder bore when lodged between the piston rings. Similarly, the thermal diode coating 13 on such surface, may also be contaminated by such deposits. To eliminate the attachment of such deposits to the surface of the piston crown, and to prevent such deposits from condensing on the coating, an ultra thin overlayer 25 (see FIG. 5) of highly inert material is placed on the thermal diffusivity coating 13. Such deposit prevention coating 25 should be a material that is preferably selected from the group consisting of gold, aluminum bronze, platinum, titanium nitrite, silicon nitrite, nickel aluminide and titanium aluminide. The deposit prevention coating 25 should be applied in a thickness preferably in the range of 100 angstroms to 5 microns. The coating, being very thin, will not interfere with the thermal diode effect of the coating on which it is overlaid. The deposit prevention coating obviously should be stable at extremely high temperatures such as about 1200° F.

Enhanced Removal of Heat From Metal Chamber Surfaces

Although the thermal diode coating 13 will restrict heat flow to the piston body 27 to the caloric capacity of the coating (thereby lowering the overall temperature of the main body mass of the aluminum piston), the piston body 27 temperature will still be sufficiently high to experience differential thermal expansion with the cylinder bore wall 31 whether the bore wall 31 is a different or the same material. To control and inhibit such differential expansion under severe conditions, a low thermal expansion/high conductivity insert 26 may be cast-in-place immediately below, but spaced from, the thermal diffusivity layer 13. The insert 26 may have a material selected from the group consisting of solid carbon, (graphite), silicon carbide, silicon nitride, titanium-aluminum alloy or a low expansion ceramic such as cordierite and beta spodumena; other materials can be used as long as they provide compatibility with the aluminum and low thermal expansion and light weight. Preferably, the insert is fabricated as a metal matrix composite of aluminum powder and low thermal expansion fibers, such as silicon nitride, silicon carbide, or aluminum oxide. The fibers should be desirably aligned in the direction of anticipated thermal growth to inhibit the thermal expansion. The insert may be formed as a perforated pancake, a ring shape, or a sliced disc of a honeycomb matrix. The insert should be cast-in-place by preheating the insert to about 40% of the temperature of molten aluminum to be cast thereabout. The insert will provide the reduced thermal growth from temperature extremes caused by the engine speed/load fluxuations.

With the differential thermal expansion control, the top circular land 28 of the piston 29 can have a tenaciously adhered, thermally conductive, abradable coating 30 which promotes a larger conductive thermal path from the piston 29 to the cylinder bore wall 31 of block 32. This allows the piston to (i) remain at a further reduced temperature, and (ii) to achieve substantially zero clearance with the cylinder bore wall 31 regardless of the effectiveness of the piston rings 33. The abradable coating 30 is deposited over the land 28 in a thickness at least equal to, but desirably slightly in excess of any clearance between the land 28 and the cylinder bore wall 31, so that during initial engine operation, the coating 30 will abrade and polish to a smooth surface conforming to the annulus of the cylinder bore wall 31 with essentially little or no radial clearance between the coating and an oil film 34 on the cylinder bore wall 31. To "abrade" in the context of this invention, means that the coating can readily wear under pressure contact against the bore wall. Abradability herein is not meant to include such materials as teflon or polymers that soften and flow to fill the piston ring grooves and thereby adversely impact ring function.

The enlarged direct thermal path from the piston through the abradable coating 30 is achieved by incorporation of conductive particles or flakes 35, such as copper or aluminum, in the coating matrix; copper flake is the preferred medium. With substantially zero clearance, the piston can operate within the cylinder bore wall with no more than a gas squeeze film lubrication therebetween, assuming the oil film on the cylinder bore wall should fail. In the event the clearance between the coating 30 and the cylinder bore wall 31 or oil film 34 thereon, is designed or allowed to become greater than 5 microns (for example, up to 10–15 microns) then the abradable coating should contain a required content of solid film lubricants. Such solid lubricants are defined to comprehend material that have coefficient of friction no greater than 0.06 at 400°–700° F. and thermally stable at such temperatures. A coating that meets such criteria preferably comprises a mixture of at least two elements selected from the group consisting of graphite, molybdenum disulfide and boron nitride; the mixture is carried in a polymer emulsion for deposition, the polymer (polyamide or epoxy thermoset type) adhering the film coating to the land surface.

To additionally control differential thermal expansion, the piston interior 29A may be sprayed with oil from the crankcase sump 37. The oil may be drawn and pumped from the sump 37 and carried up the connecting rod 38 and thereafter sprayed through radial openings 39 in the connecting rod small end 38A to bathe the interior surface 29A of the piston 29. Such oil spray cooling of the underside 29A of the piston, and splash cooling of the cylinder wall 34, will maintain the piston-cylinder bore clearance 40 in the designed range, which preferably is essentially 0. In the event of oil spray failure, the resulting overheating of the piston crown and its enlargement would ordinarily cause engine failure; the abradable coating prevents catastrophic failure.

Figure 6:
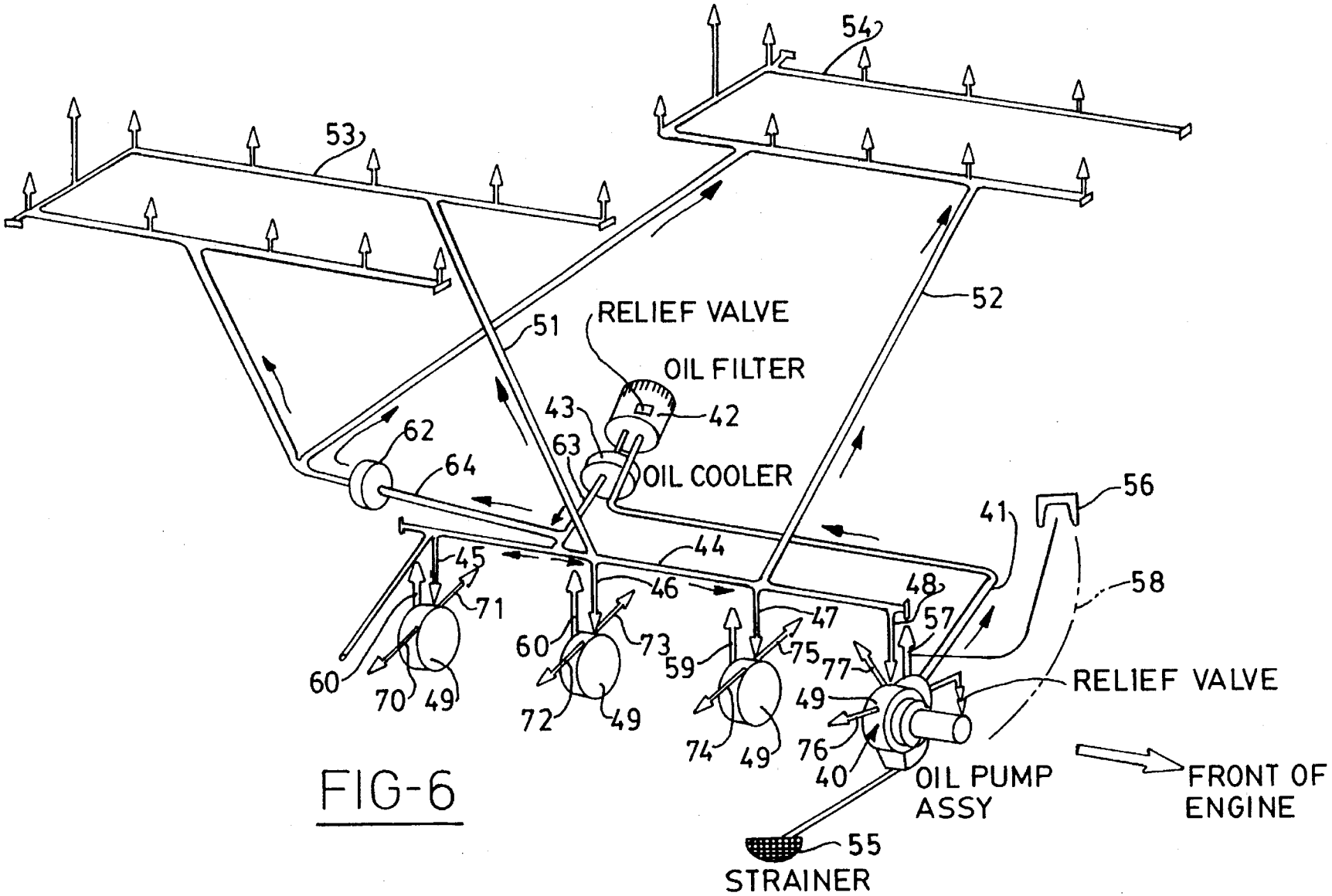
FIG. 6 is a schematic representation of a single oil path arrangement for lubricating the valve train and combustion area of the engine, the arrangement using dual cooling.

To enhance the efficiency of oil cooling of the piston and cylinder wall, the oil circuit for piston cooling should be separated from other oil cooling tasks, such as for crankshaft and valve train lubrication and cooling. As shown in FIG. 6 a dual cooling single circuit for a V-8 engine block comprises a main line oil pump 40 which delivers pressurized fluid along a line 41 to an oil filter 42 and a first oil cooler 43 and thence to a main horizontal returning line 44. Downward feeding lines 45, 46, 47 and 48 (from four stations along the main return line 44) supply oil respectively to crankshaft bearings 49. Upward feeding lines 51 and 52 each supply oil respectively to valve train layout 53,54 for each engine head on each side of the V-configuration block; oil returns to sump 55 from layouts 53, 54 by lines not shown. To provide additional cooling of the oil circulated to the valve train layouts, a second cooler 62 is used, in a line 64 to cool oil taken off the line 63 coming out of the first oil cooler 43; line 64 divides and connects to valve train layouts at other locations. The second oil cooler 62 should maintain oil to a maximum temperature of about 160° F. Such reduced temperature facilitates lowering the overall temperature of the engine heads and thereby limits the heat that can transfer to the intake charge from the intake ports and intake manifold.

Figure 7:
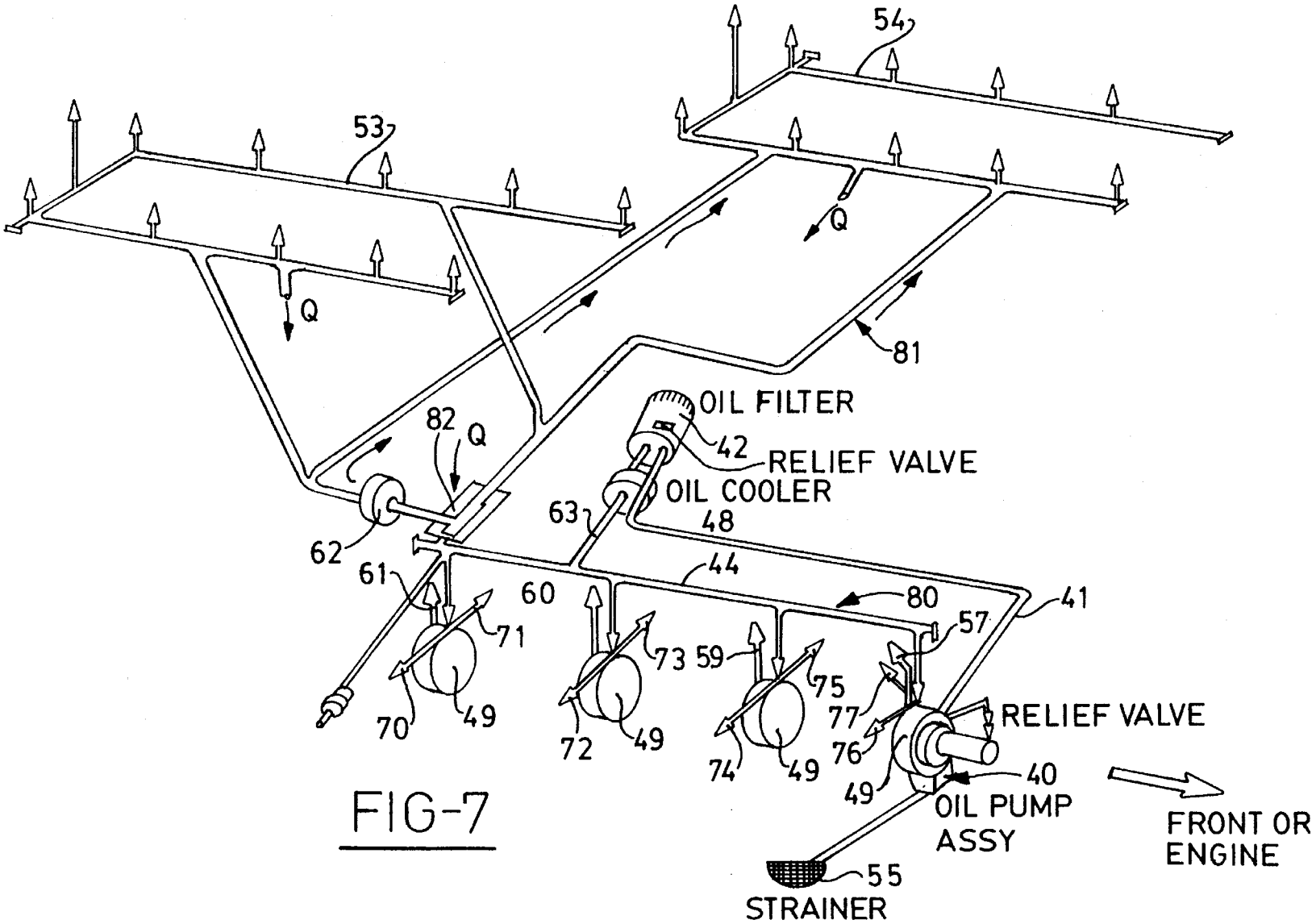
FIG. 7 is a schematic representation of a dual oil path arrangement for lubricating different parts of the engine, the arrangement facilitating use of lower viscosity oil in cooling the piston.

To facilitate use of a lower viscosity oil for only the pistons and cylinder walls, FIG. 7 shows an arrangement where the oil circulated to the valve train layouts is isolated from the main oil circuit 80 for the pistons and cylinder walls; such isolated oil circuit 81 has its own small electric oil pump 82 to provide circulation.

Oil cooling for the interior of pistons 56 is illustrated by an upwardly extending line 57 carrying oil upwardly to the piston interior. As more particularly shown in FIG. 1, oil to the interior of the piston may be carried through connecting rod 38 or equivalent to be sprayed along the piston interior, and thence returned to sump 55 along path 58. Similar lines 59,60 and 61 extend upwardly from each crankshaft bearing to feed the other pistons along one side of the engine; complementary lines with complementary pumps would feed the pistons on the other side of the engine. Oil to the eight cylinder bore walls is splashed from ports in the crankshaft bearings, such as designated by 70, 71, 72, 73, 74, 75, 76 and 77.

The oil for this circuit 80 should be lower in viscosity, such as 3 to 5 Cp at 40° C. (compared to 100 Cp for conventional engine oil systems) because the lower viscosity reduces engine friction and oil pump power losses at well below 0° F. The importance of isolating the piston-cylinder wall circuit is to facilitate low friction and easy pumping at very cold temperatures.

The invention in another aspect, is a method of thermally managing heat generated by an internal combustion engine having to move a piston along a wall, such engine having a combustion chamber for combusting a gaseous mixture of air and fuel, and further having a cooling jacket for cooling such wall. The method comprises increasing the compression ratio of the engine (i.e. about 10–20%); coating the crown of the piston that faces the combustion chamber with a low thermal diffusivity layer that functions as a heat diode; and operating the engine with such coated piston and increased compression ratio whereby a fresh intake mixture to the combustion chamber will be drawn thereinto at a lower temperature in greater volumetric efficiency and with less heat from the piston crown transferred to such charge. Less heat from combustion will be wasted to the cooling jacket. For an engine sized at about 3.0 liter, the compression ratio can be increased from about 8:1 to about 10:1. The fresh intake mixture to the engine can be decreased in temperature from about 160° F. to about 120° F. at the start of the compression stroke. Less heat is transferred to the charge by exposure to the coated layer of the piston whereby snored heat from a previous piston operation cycle is prevented from heating this fresh charge prior to combustion. The thickness of the coating should be minimized to satisfy the equation for low diffusivity (i.e. less than 1 mm).

Figure 8:
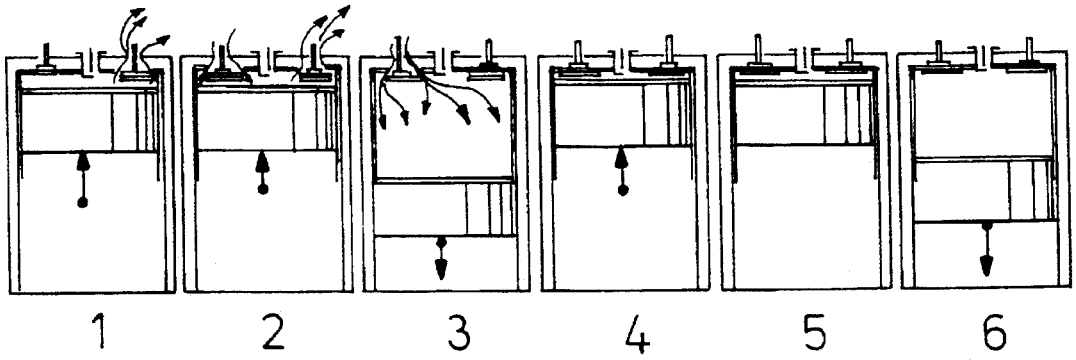
FIG. 8 is a composite illustration of the stages of a four-stroke cycle engine showing heat flow restriction as a result of the coatings and thereby facilitating higher compression ratios.

Thus as shown in FIG. 8, in stage one the coated piston is almost to the completion of an exhaust stroke with only the exhaust valve open. With a very short travel to the total completion of the exhaust stroke (as in stage two) both intake and exhaust valves will be opened. As the inducted charge is drawn into the cylinder bore (stage three) at about a temperature of 90°–100° F. (typical of intake duct temperatures), a transfer of heat takes place from the coating 13 (previously heated by cyclic operation) but is severely limited by the caloric content of the coating and by the restricted thermal conductivity of the coating. Such charge will rise in temperature to about 120° F. during induction. Since a greater mass of mixture can now be introduced to the combustion chamber due to its lower temperature of 120° F. and greater density (as opposed to prior art temperatures of 160° F.) the volumetric efficiency is increased, allowing the engine designer to increase the compression ratio (for example from about 8:1 to 10:1) without fear of the charge reaching the auto ignition temperature (i.e. of about 800° F.) during the compression stroke (stage four). The coating restricts heat transfer to the charge from the combustion chamber walls during compression by the nature of its low diffusivity. Ignition takes place (stage five) and during expansion, throttle heat transferred to the piston and chamber walls will occur as a result of the presence of the low diffusivity coating, which reserves a greater amount of combustion heat to do work during such power stroke.

The thermal diode coating may further be protected with a deposit preventing coating, such as gold in a whisper thin layer. The method may further comprehend fabricating the piston to not only have a heat diode coating on its crown, but also a low thermal expansion high conductivity implant immediately below the diode coating. This retains the shape of the crown to accommodate the thermal expansion changes resulting from engine speed/load fluxuations and to rapidly dissipate heat into the oil spray to minimize the temperature rise in the piston.

The method may further comprehend fabricating the piston to provide for increased heat sink capabilities such as (i) a thermally conductive abradable top land coating, effective to transfer heat to the engine block, and/or (ii) an oil spray system for bathing the interior surfaces of the piston with oil effective to transfer heat to the oil cooling system of the engine.

We claim:

1. A heat engine piston and combustion chamber construction enclosing a gas combustion zone, said engine inducting a combustible charge into said zone for combustion, comprising:

(a) a piston body having a crown facing said gas combustion zone;

b) combustion chamber surfaces cooperating with said piston to complete enclosure of said zone; and c) a low thermal diffusivity coating on said crown and combustion chamber surfaces having an effective thickness to operate as a thermal diode to restrict heat transfer to said piston body and combustion chamber construction and to restrict heat transfer to said combustible charge prior to combustion.

2. The construction as in claim 1 in which said coating has a thermal diffusivity in the range of near zero to 70 metric units (relative to 93 for Aluminum piston).

3. A heat engine piston and combustion chamber construction enclosing a gas combustion zone, said engine inducting a combustible charge into said zone for combustion, comprising:

(a) a piston body having a crown facing said gas combustion zone;

(b) combustion chamber surfaces cooperating with said piston to complete enclosure of said zone; and (c) a low thermal diffusivity coating on said crown and combustion chamber surfaces having an effective thickness to operate as a thermal diode to restrict heat transfer to said piston body and combustion chamber construction and to restrict heat transfer to said inducted combustible charge prior to combustion, the thickness of said thermal diffusivity coating being in the range of 0.5 mm to 1.8 mm.

4. The construction as in claim 3 in which said coating consists of thorium oxide having a thickness of about 0.7 mm (700 microns).

5. The construction as in claim 3 in which said thermal diffusivity coating consists of zirconium oxide having a thickness of about 0.76 mm.

6. The construction as in claim 3 in which said thermal diffusivity coating consists of titanium aluminum alloy having a thickness of about 0.8 mm.

7. The construction as in claim 3 in which said thermal diffusivity coating consists of stainless steel having 22% by weight content of chromium, and having a thickness of about 0.85 mm.

8. The construction as in claim 1 in which said engine has an enhanced heat sink to reduce the temperature differential between said coating and said crown or chamber surfaces.

9. The construction as in claim 1 in which said engine has air gap insulation to prevent heat transfer from said engine to said charge prior to entering said zone.

10. The construction as in claim 8 in which said heat sink comprises a cooled block and head of aluminum alloy and comprises a thermally conductive anti-friction abradable coating on at least some portion of said piston side walls to effect a close fitting thermal path to said cooled block and head.

11. The construction as in claim 8 in which said piston body is aluminum and said enhanced heat sink comprises means for spraying oil lubricant onto the interior of said piston body.

12. The construction as in claim 11 which additionally comprises a piston body having an implanted insert submerged adjacent and along the thermal diffusivity coating, said implant being constituted of a low thermal expansion high thermal conductivity material.

13. The construction as in claim 12, in which said insert has a thickness of about 1 mm to 4 mm and consists of a metal matrix composite of aluminum powder and one or more of silicon nitride, silicon carbide or aluminum oxide fibers oriented in the direction of anticipated thermal growth; or molded carbon graphite on a graphite matrix honeycomb with at least 20% open porosity.

14. The construction as in claim 1 in which said piston crown additionally comprises an ultra thin carbon deposit prevention coating overlaying said thermal diffusivity coating.

15. The construction as in claim 1 in which said carbon deposit prevention coating has a material selected from the group consisting of gold, aluminum bronze, platinum, titanium nitride, titanium aluminide and copper oxide, and said carbon deposit prevention coating having a thickness in the range of 100 angstroms to 10 microns.

16. A method of thermally managing heat generated by an internal combustion engine, said engine having combustion chamber walls for combusting a gaseous mixture of air and fuel, a cooling jacket for cooling said walls, and a piston moveable along a portion of said walls, comprising:

(a) increasing the compression ratio of the engine to induce engine-knock for an uncoated chamber;

(b) coating at least the crown of the piston and said combustion chamber walls with a low thermal diffusivity layer that functions as a heat diode to restrict heat transfer in both directions normal to the coating;

(c) operating said engine with said coated chamber walls and increased compression ratio, whereby fresh intake of combustible mixture to said combustion chamber will be drawn thereinto at a lower temperature and volumetric efficiency with less heat from said combustion being wasted to said cooling jacket.

17. The method as in claim 16 in which the compression ratio for said engine, sized at about 2.5–4.0 L, is increased from 8:1 to 10:1.

18. The method as in claim 16 in which the fresh intake mixture is increased approximately 30° F. in temperature from an ambient underhood temperature, by exposure to the coated layer of said piston whereby limited stored heat from a previous piston operating cycle is released to such fresh charge mixture.

19. The method as in claim 16 in which the thickness of said coating is determined as a minimum thickness needed to satisfy the equation: thermal diffusivity=thermal conductivity/density x mass specific heat capacity.

20. The method as in claim 16 in which in step (b), said coating is further protected by a deposit preventing coating overlaid thereon in a thickness of 100 angstroms to 10 microns.

21. The method as in claim 16 in which in step (b), said piston is further fabricated to provide increased heat sink capability by the use of at least one of (i) a thermally conductive abradable top land coating effective to transfer heat to the engine block, and/or (ii) an oil spray system for bathing the interior surfaces of the piston with oil effective to transfer heat to the oil cooling system of the engine.

* * * * *